US006170113B1

(12) United States Patent
Cornu et al.

(10) Patent No.: US 6,170,113 B1
(45) Date of Patent: Jan. 9, 2001

(54) TOOTHBRUSH WITH HANDLE COMPRISING MEANS FOR VERTICAL STORAGE

(75) Inventors: Jean-Michel Cornu; Veronique Malcourant, both of Paris (FR)

(73) Assignee: Sanofi-Synthelabo, Paris (FR)

( * ) Notice: Under 35 U.S.C. 154(b), the term of this patent shall be extended for 0 days.

(21) Appl. No.: 09/194,597

(22) PCT Filed: Mar. 26, 1998

(86) PCT No.: PCT/FR98/00623

§ 371 Date: Jun. 22, 1999

§ 102(e) Date: Jun. 22, 1999

(87) PCT Pub. No.: WO98/43516

PCT Pub. Date: Oct. 8, 1998

(30) Foreign Application Priority Data

Mar. 28, 1997 (FR) ..... 97/03819

(51) Int. Cl.[7] ..... A46B 5/00

(52) U.S. Cl. ..... 15/167.1; 15/143.1; 16/110.1; 248/688; 401/131; D4/108

(58) Field of Search ..... 15/143.1, 167.1; 16/110.1, 436; 132/308, 311; 248/688; 401/131; D4/104, 108

(56) References Cited

U.S. PATENT DOCUMENTS

| | | | | |
|---|---|---|---|---|
| 153,983 | * | 8/1874 | Rontey | 248/688 X |
| 286,699 | * | 10/1883 | Hornberger | 248/688 X |
| D. 301,402 | * | 6/1989 | Hirsch | D4/108 |
| D. 408,997 | * | 5/1999 | Holland | D4/108 |
| 1,870,924 | * | 8/1932 | Platzer | 248/688 |

FOREIGN PATENT DOCUMENTS

| | | | | |
|---|---|---|---|---|
| 87895 | * | 4/1922 | (AT) | 248/688 |
| 7-313251 | * | 12/1995 | (JP) . | |

* cited by examiner

*Primary Examiner*—Mark Spisich
(74) *Attorney, Agent, or Firm*—Arthur L. Plevy; Buchanan Ingersoll PC

(57) ABSTRACT

The invention concerns a toothbrush (10) with bristles (12) at the top and a handle (14) including a structure for maintaining the brush in a vertical storage position, characterized in that the brush handle (14) is longitudinally divided in its upper part into at least two branches (16,18,20) articulated between an open position for storage wherein the free ends (22,24,26) of the branches (16,18,20), mutually spaced, form support points for the brush (10) on a horizontal surface, and a closed position wherein the branches are brought together for the toothbrush (10) to be used.

16 Claims, 1 Drawing Sheet

TOOTHBRUSH WITH HANDLE COMPRISING MEANS FOR VERTICAL STORAGE

The present invention relates to a toothbrush.

The object of the invention is to improve the hygiene and ease of use of a toothbrush possessing a bristled head and a handle.

For optimum hygiene of the brush, and in particular of the bristled part of the head, it is generally necessary to ensure, when the toothbrush is stored, that the bristled part is not in contact with any surface. To this end, the best position for the brush is in a vertical stance thereof, the head being positioned upwards. This arrangement additionally allows the water to flow from the bristled part towards the bottom and hence rapid drying of the bristles.

For this purpose, it is already known to use a number of solutions comprising a support, the simplest being to stand the brush in a tooth mug. However, this system has the disadvantage of retaining the water flowing from the bristled part of the brush with the risk of maceration caused by the draining water in the bottom of the mug.

Other solutions exist, comprising a support placed on any surface and on which the bottom part of the handle of the brush is placed, thus leaving the head of the brush open to the air and enabling the water to drain away. However, these systems have the disadvantages of being bulky, somewhat impractical and liable to become unusable if the support is lost.

In order to remedy the above mentioned problems, it is known to use brushes whose handle possesses its own means for retaining the brush in the vertical position. Thus, it has been proposed that use be made of a toothbrush of which the base of the handle possesses a weighting element to bring the brush back into the vertical position or that use be made of a suction disc fixed to the bottom of the handle.

It is also known to use a handle of thick section whose free end is radially flat, forming a horizontal surface to bear on any plane.

By way of example of toothbrushes of which the base of the handle comprises its own means of maintaining it in the vertical position, there is also Japanese Patent Application JP-A-7,313,251, whose base comprises three fixed branches arranged as a tripod.

However, these devices likewise have disadvantages, specifically the substantial complexity of the industrial assembly of these systems, their high cost and, above all, a particular conformation of the handle or its base which makes its use somewhat impractical.

In order to remedy the disadvantages cited above, the present invention proposes a toothbrush of the type possessing a bristled head and a handle comprising means for supporting the brush in a vertical storage position, characterised in that the handle of the brush is divided lengthwise from its upper part into at least two branches pivotable between an open storage position in which the free ends of the branches, at a distance from each other, form the points whereby the brush bears on a horizontal surface, and a closed position in which the branches are united for the use of the toothbrush.

According to other features of the invention:

- the branches are moved back resiliently into the open position after use of the brush;
- the brush comprises means for retaining the branches in the closed position;
- the means for retaining the branches of the brush in the closed position are formed by a ring which slides lengthwise along the handle and whose internal profile is complementary to the external profile of the handle in the closed position of the branches;
- the handle is divided into three branches distributed angularly in a regular manner around the longitudinal axis of the handle;
- the handle is produced from a single piece of plastic, split lengthwise into at least two branches;
- the toothbrush is produced from a single moulded piece comprising the handle and the head;
- the hinge of each branch is formed by a thin portion situated at the upper end of the branch;
- the thin portion is situated on the internal surface of the branch, thus defining, in the united position of the branches, an internal cavity in the handle;
- one of the slits between two adjacent branches is perpendicular to a longitudinal plane parallel to the head of the brush and is situated on the same side as the bristled surface of the head.

Other features and advantages of the invention will become apparent on reading the detailed description which follows, for the understanding of which reference will be made to the attached drawings, in which.

In FIGS. 1 to 5 a toothbrush 10 is shown which, in accordance with a known design, possesses a bristled head 12 for brushing the teeth and a gripping handle 14 which is connected thereto, in its upper part, by a thin portion 13.

Figure 1:
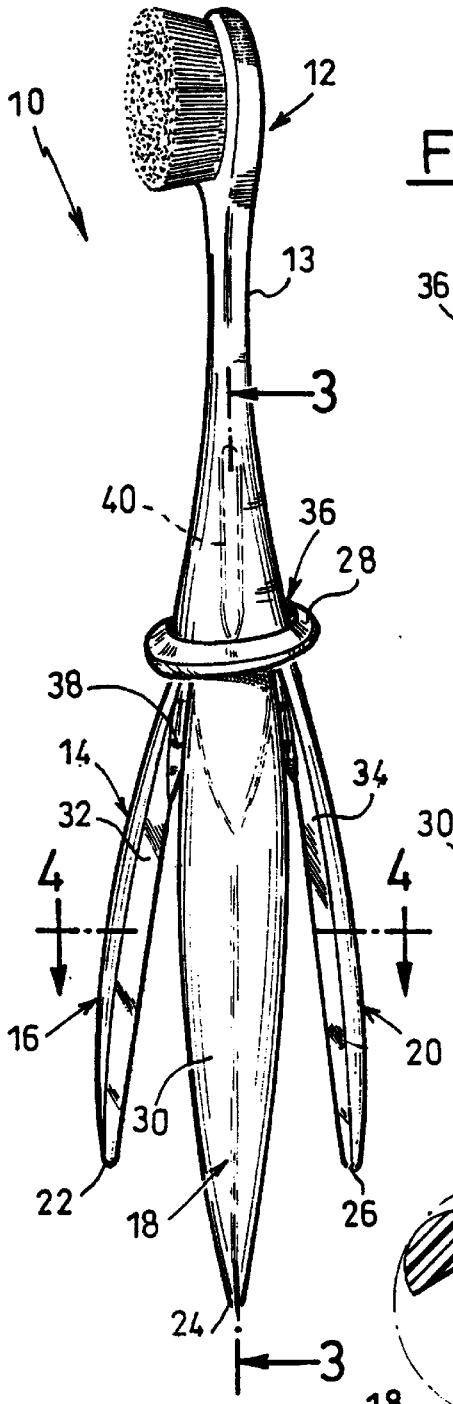
FIG. 1 is a general perspective view of the brush in the open position of the branches.
Figure 3:
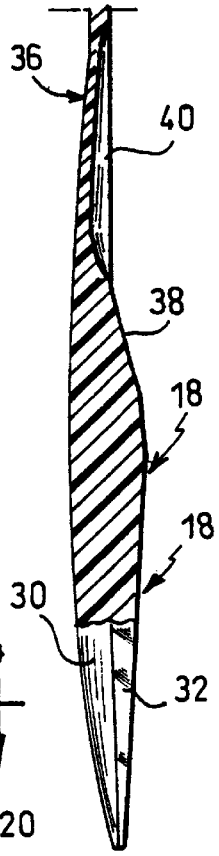
FIG. 3 is a view in longitudinal section along the line 3—3 in FIG. 1 of one of the branches of the handle.
Figure 2:
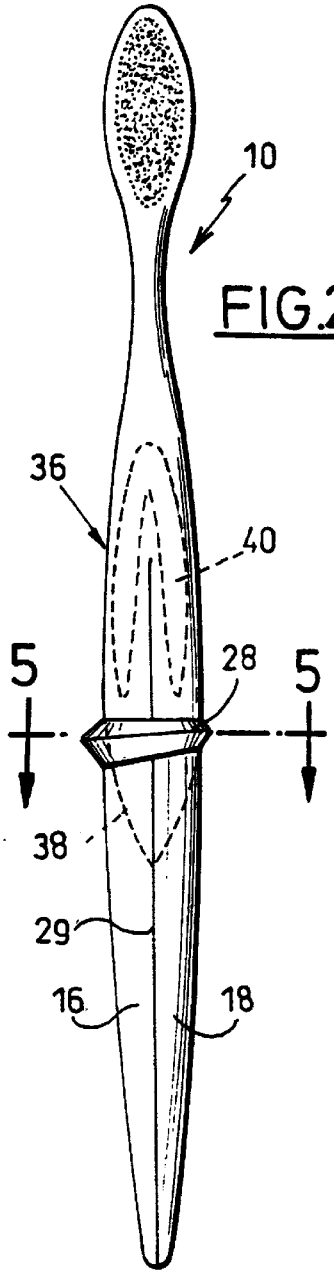
FIG. 2 is a frontal view of the brush with the branches held in the closed position.

According to the teaching of the invention, the handle 14 of the toothbrush 10 is divided, from its upper part, into three branches 16, 18 and 20, which are pivotable between an open position, illustrated in FIG. 1, and a closed position, shown in FIG. 2.

In the open position, the branches 16, 18 and 20 of the handle 14 are at a distance from one another radially and their respective feet 22, 24 and 26 form the points whereby the brush, in the vertical position, bears on any horizontal surface. This arrangement enables the brush to be stored in a vertical orientation on any surface and without accessories or an additional support, the handle forming a supporting tripod.

In the closed position, for the use of the brush, the branches 16, 18 and 20 can be brought together to form a block similar to the traditional handle of a toothbrush, having in this case a profile of rotation, this taking place against a resilient stress which restores the branches 16, 18 and 20 to their open position.

The natural state of rest of the branches 16, 18 and 20 of the brush 10 is the open position, in which the branches 16, 18 and 20 are at a distance from one another. The branches 16, 18 and 20 are restored resiliently to their open position, that is to say with the branches at a distance from one another to allow the storage of the brush.

In order to avoid the premature restoration of the branches 16, 18 and 20 to the open position during brushing of the teeth and to improve the comfort of the grip on the handle, the branches 16, 18 and 20 are retained in the closed position.

The means for retaining the branches 16, 18 and 20 in the closed position comprise a ring 28 which slides lengthwise along the upper part of the handle 14 and whose shape is substantially complementary to that of the handle 14 in the region in which the three branches 16, 18, 20 come together to form the handle 14.

The ring 28 has the advantages of being compact, of being easily positioned by skiding around the upper bristled ends 12 of the brush 10, and of being able to slide easily along the handle 14, thus allowing the user to slip it along the handle with a single hand.

Thus arranged, the ring 28 is retained towards the top by the bristles of the head 12 of the brush 10 and at the bottom by the larger diameter of the handle 14, slightly greater than the internal diameter of the ring 28, when the branches 16, 18 and 20 are brought together in the closed position.

To obtain the restoration of the branches to the open position, it is sufficient to move the ring 28 back up along the handle towards the thin portion 13, the branches 16, 18 and 20 of the handle 14 thus returning to their natural, spaced position, the ring 28 being simply at rest around the upper part of the handle 14.

According to the form of embodiment shown in the figures, the handle 14 is divided into three branches 16, 18 and 20 distributed angularly in a regular manner around the longitudinal axis.

The three branches 16, 18 and 20, thus distributed in accordance with angles of approximately 120°, are oriented so that one 29 of the slits between two surfaces of adjacent branches is situated in a plane perpendicular to the plane defined by the head of the brush, and situated relative to the longitudinal axis in the same direction as the bristles of the head 12 of the brush.

Figure 4:
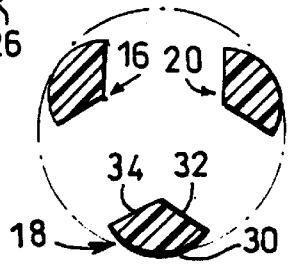
FIG. 4 is a radial section along the line 4—4 in FIG. 1.

As can be seen more particularly in FIG. 4, each of the branches 16, 18 and 20, of substantially triangular section, is delimited by an external arcuate part 30 and by two planar internal surfaces 32 and 34 of radial orientation and arranged at 120°. During the transition from the open position to the closed position of the brush, the surface 32 of each branch comes to bear upon the surface 34 of the adjacent branch.

According to the same form of embodiment, the body of the brush 10 is produced from a single piece, for example from a piece moulded from plastic, comprising both the head 12 and the handle 14 of the brush 10, the handle 14 being itself divided into three branches 16, 18 and 20 by moulding.

The moulding of the brush 10, produced in the open position of the branches, enables the hinges of the branches 16, 18 and 20 to be produced. Each of the hinges is formed, to this end, by a thin portion of the branch corresponding to its upper end 36, as can be seen more particularly in FIG. 3.

This thin portion is more specifically defined by a facet 38 which is inclined relative to the longitudinal axis of the brush 10 and from the latter. This facet 38 is oriented to slant upwards and from the inside to the outside, thus intersecting at a slant the two planar internal surfaces 32 and 34. This internal facet 38 extends to a certain depth into the branch, without going as far as the periphery, and itself comprises a groove 40 of generally elongate shape.

When the branches 16, 18 and 20 of the handle 14 of the brush 10 are brought together for the use of the brush 10, as shown in FIG. 2, the upper part 36, corresponding to the region of the facet 38 and of the groove 40, is subjected to a bending stress against the natural elasticity of the moulding material to allow the three branches to be brought together.

Figure 5:
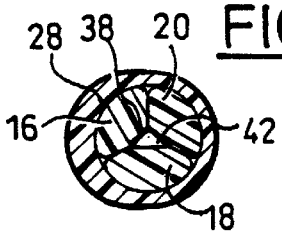
FIG. 5 is a radial section along the line 5—5 in FIG. 2.

As can be seen more particularly in FIG. 5, in the united position, the handle exhibits in its central part a cavity 42 which corresponds to the regions defined by the facets 38 of the various branches.

In accordance with the teaching of the invention, the toothbrush thus defined therefore has the advantages of offering a solution to the problem of easy storage of the brush, forming a tripod on any broadly horizontal surface without any additional accessory, and being simple to use when the handle is in the closed position.

The transition from the closed position to the open position is easily effected by a lengthwise upward movement of the ring 28.

This ring 28 is retained between the head 12 of the brush 10, whose bristles are sufficiently long to retain the ring, and the part of the sleeve from which the diameter of the ring is too small, relative to that of the united branches, to be able to slide downwards along the handle.

By way of an alternative embodiment, the handle 14 of the toothbrush 10 may possess only two branches bearing on the surfaces or ridges situated at the base of each branch, or may possess four branches or more.

According to another alternative embodiment, the brush 10 may possess different means for retaining the brush in different closed positions. By way of example, the sliding ring may be replaced by a ring of threaded internal shape which interacts with an external threading on the handle 14 of the brush, or it may be controlled by a traveller situated on the handle 14 which slides lengthwise along the latter under pressure from the thumb of the user in order to allow the transition from one position to the other.

According to another alternative embodiment, the handle 14 of the brush may possess one or more projections, or a channel, in order to prevent the ring from being able to shift too far lengthwise towards the lower end of the brush, beyond the position in which it locks the branches in the closed position.

What is claimed is:

1. A toothbrush, comprising:

a head having a bristled surface; and a handle extending from said head, said handle comprising means for supporting said brush in a vertical storage position, said handle of said brush being divided lengthwise from its upper part into at least two branches pivotable between an open storage position in which the free ends of said branches, at a distance from each other, form the points whereby said toothbrush bears on a horizontal surface, and a closed position in which said branches are united for the use of said toothbrush, said handle being produced from a single piece of plastic, split lengthwise to define said at least two branches, said branches distributed angularly in a regular manner around the longitudinal axis of said handle.

2. A toothbrush according to claim 1, wherein said branches are moved resiliently into said open position.

3. A toothbrush according to claim 2, wherein said brush comprises means for retaining said branches in said closed position.

4. A toothbrush according to claim 3, wherein said means for retaining the branches of said brush in said closed position are formed by a ring which slides lengthwise along said handle and whose internal profile is complementary to the external profile of said handle in said closed position of said branches.

5. A toothbrush according to claim 1, wherein said handle is divided into three branches with slits between adjacent branches, said branches distributed angularly in a regular manner around the longitudinal axis of said handle.

6. A toothbrush according to claim 5, wherein one of the slits between two adjacent branches is perpendicular to a longitudinal plane parallel to said head of said brush and is situated on the same side as said bristled surface of said head.

7. A toothbrush according to claim 1, wherein each branch includes a hinge formed by a thin portion situated at the upper end of each branch.

8. A toothbrush according to claim 7 wherein said thin portion is situated on the internal surface of each branch, thus defining, in said closed position of said branches, an internal cavity in said handle.

9. A toothbrush, comprising:

a head having a bristled surface; and a handle extending from said head, said handle comprising means for supporting the brush in a vertical storage position, said handle of said brush being divided lengthwise from its upper part into at least two branches pivotable between an open storage position in which the free ends of said branches, at a distance from each other, form the points whereby said toothbrush bears on a horizontal surface, and a closed position in which said branches are united for the use of said toothbrush, said handle being produced from a single molded piece comprising said handle and said head which is split lengthwise to define said at least two branches.

10. A toothbrush according to claim 9, wherein said branches are moved resiliently into said open position.

11. A toothbrush according to claim 10, wherein said brush comprises means for retaining said branches in said closed position.

12. A toothbrush according to claim 11, wherein said means for retaining said branches of said brush in said closed position are formed by a ring which slides lengthwise along said handle and whose internal profile is complementary to the external profile of said handle in said closed position of said branches.

13. A toothbrush according to claim 9, wherein said handle is divided into three branches with slits between adjacent branches, said branches distributed angularly in a regular manner around the longitudinal axis of said handle.

14. A toothbrush according to claim 13, wherein one of the slits between two adjacent branches is perpendicular to a longitudinal plane parallel to said head of said brush and is situated on the same side as said bristled surface of said head.

15. A toothbrush according to claim 9, wherein each branch includes a hinge formed by a thin portion situated at the upper end of each branch.

16. A toothbrush according to claim 15, wherein said thin portion is situated on the internal surface of each branch, thus defining, in said closed position of said branches, an internal cavity in said handle.

* * * * *